United States Patent [19]

Crow

[11] Patent Number: 4,677,694

[45] Date of Patent: Jul. 7, 1987

[54] FACIAL PROTECTOR FOR BATTING HELMET

[76] Inventor: Robert W. Crow, 4400 Harris Valley Rd., Atlanta, Ga. 30327

[21] Appl. No.: 886,532

[22] Filed: Jul. 16, 1986

[51] Int. Cl.[4] ..... A41D 13/00

[52] U.S. Cl. ..... 2/9; 2/10; 2/425

[58] Field of Search ..... 2/9, 10, 423, 424, 425

[56] References Cited

U.S. PATENT DOCUMENTS

| | | | |
|---|---|---|---|
| 1,868,926 | 7/1932 | Tatore et al. | 2/425 X |
| 2,214,748 | 9/1940 | Mauro | 2/423 |
| 3,067,427 | 12/1962 | McClintock | 2/9 |
| 3,886,596 | 6/1975 | Franklin et al. | 2/10 X |

*Primary Examiner*—Louis K. Rimrodt

*Attorney, Agent, or Firm*—Banner, Birch, McKie & Beckett

[57] ABSTRACT

A protective flap for a batting helmet. The protective flap attaches to a batting helmet or is fabricated with the helmet, and extends alongside the cheek and jaw of the batter. The protective flap can attach to the ear cover of the batting helmet, and extends forwardly to an outer end approximately aligned with the front of the batter's chin or nose. The upper edge of the protective flap is spaced below the visor of the helmet to allow substantially unobstructed vision but this spacing is less than the diameter of the ball in play, to prevent the ball from striking the batter's cheek or eye.

6 Claims, 5 Drawing Figures

FACIAL PROTECTOR FOR BATTING HELMET

FIELD OF THE INVENTION

This invention relates in general to protective headgear, and relates in particular to a facial protector for protective helmets worn by batters in baseball, softball, and the like.

BACKGROUND OF THE INVENTION

Participants in many different kinds of sports typically wear protective headgear intended to prevent or minimize injury. This protective headgear typically takes the form of helmets or caps worn to prevent head injuries resulting either from hard physical contact with other players or from contact with a fast-moving ball or other object used in playing the game.

One specific example of protective headgear is the batting helmet now almost universally worn by batterns in baseball or softball. In these games, the stance assumed by the batter places either his left or right side substantially facing the pitcher, leaving one side of the batter's face exposed close to the path of oncoming pitched balls. Major-league baseball pitches can throw fastballs at speeds exceeding 60 mph (88 ft/sec), leaving little time for even a well-conditioned ball player to react and avoid an erratic or mispitched ball moving on a path toward the batter's head. The sudden impact of a pitched baseball striking a side of the batter's face can fracture the cheekbone or jawbone, requiring extensive reconstructive surgery and sidelining the player during the reconstructive and healing processes.

This problem is no less important with amateur baseball or softball players, and particularly with youth league players such as Little League and the like. Pitchers at these levels of play, while usually incapable of the throwing speeds common in major-league pitching, may also lack the control of more experienced pitchers. Moreover, the amateur or youthful batter may be too inexperienced to reflexively avoid an oncoming pitch thrown or to veering toward the batter's face. Serious injuries incurred by a youthful player are particularly upsetting and can lead to damage claims by the batter or the batter's parents. Even the fear of being hit in the face by a pitched ball may make youthful players less effective as batters.

The conventional present-day batting helmet includes a side portion extending downwardly over the batter's ear and including an opening located over the ear itself. This side portion usually is located on the side of the helmet facing the pitcher, and the location thus depends on whether the batter is right- or left-handed. However, this side portion of the conventional batter's helmet protects only the side of the batter's cranium, leaving the cheek and jaw completely exposed and unprotected.

Other expedient measures for protecting batters have been proposed, with little or no known adoption by ball players. One such measure, shown in U.S. Pat. No. 3,067,427, includes a face guard extending fully around the batter's face, much like the face guard of a football helmet. However, this face guard is capable of protecting only a relatively narrow portion of the batter's face. Another such measure, shown in U.S. Pat. No. 3,886,596, includes a full-face shield of rigid construction and lacking padding.

Another prior-art effort toward solving the problem is the batter's mask disclosed in U.S. Pat. No. 1,868,926.

That reference describes a batter's mask having an open wire frame surrounding the cranium and extending downwardly on one side of the batter's head. However, the mask leaves parts of the batter's face exposed, and apparently relies to some extent on the ability of the mask to deflect oncoming balls and thereby minimize damage to the batter. In any case, this prior art discloses a construction not readily adaptable to present-day batting helmets.

SUMMARY OF THE INVENTION

Stated in general terms, the present invention is a facial protector attached to a protective cap or helmet intended for wear by a batter. The protective flap extends forwardly from a side of the domed shell comprising the helmet, and this protective flap overlaps the cheekbone and jaw on a side of the batter's face. The protective flap has an upper edge spaced below the conventional visor extending forwardly from the helmet, leaving an open and unobstructed region between the visor and the protective flap for the batter's vision. This protective flap can be integrally formed as part of the domed shell making up the batting helmet, or can readily be attached to an existing batting helmet.

Stated somewhat more specifically, the upper edge of the protective flap in the present invention is spaced below the helmet visor a distance less than the diameter of the ball in play, sufficient to prevent a pitched ball from entering the open region for the batter's vision and thereby protecting the batter's eye and cheekbone from injury by a ball squarely striking the cap in this region.

Stated with further particularity, the present protective flap is either affixed to the ear protective panel of an existing helmet or forms an integral extension from the ear panel, and the protective flap extends forwardly from the ear panel to lie alongside the cheekbone and jaw of the wearer. The upper edge of the protective flap is preferably located below the visor a distance less than the diameter of the ball in play, and the lower edge of the protective flap preferably is substantially coextensive with the lower line of the batter's jaw. The protective flap preferably extends forwardly to a distal end in line along the nasal labial fold toward the batter's nose. The protective flap thus protects the cheekbone, jawbone, and nose from direct contact by an oncoming ball. The inner side of the protective flap is padded with a material which absorbs or dissipates the sudden impact caused by an oncoming ball.

Accordingly, it is an object of the present invention to provide a protective flap for a batting helmet.

It is another object of the present invention to provide a protective flap for a batting helmet providing substantially full side-facial protection against pitched balls.

It is still another object of the present invention to provide a batting helmet equipped with a protective flap which protects the cheekbone and jawbone of the batter from injury by a pitched ball.

It is a further object of the present invention to provide a batting helmet with a protective flap giving improved facial protection, while leaving the batter's vision toward the pitcher substantially unimpaired.

Other objects and advantages of the present invention will become more readily apparent from the following description of a preferred embodiment.

DETAILED DESCRIPTION OF PREFERRED EMBODIMENT

Figure 1:
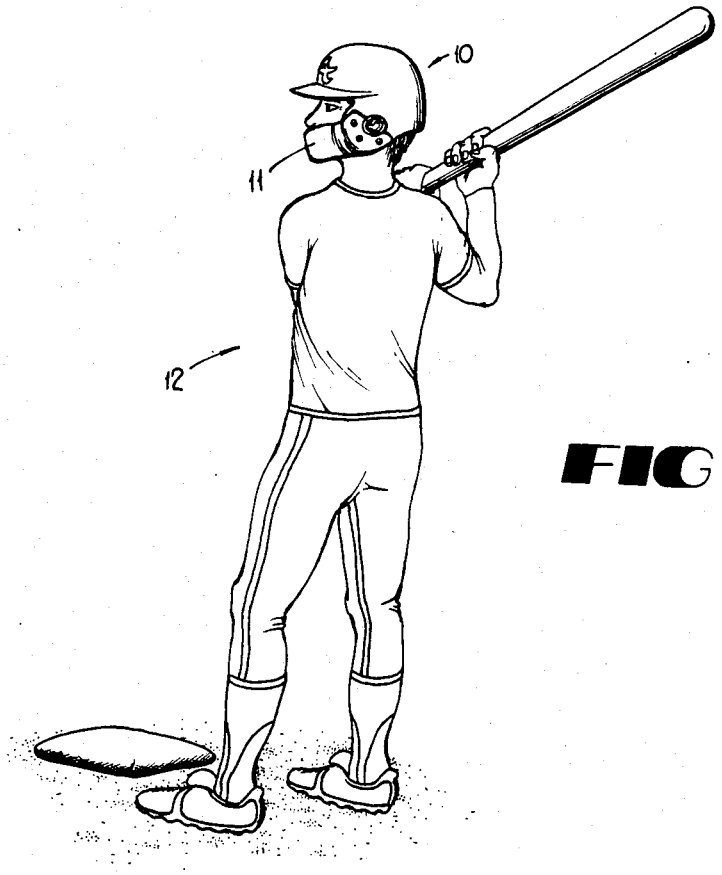
FIG. 1 is a pictorial view showing a batter wearing a helmet with a protective flap according to a preferred embodiment of the present invention.

Turning first to FIG. 1, there is shown generally at 10 a batting helmet including a protective flap 11 on the left side of the helmet, according to a preferred embodiment of the present invention. This particular batter 12 is batting right-handed, and so the protective flap 11 extends alongside the jaw and cheek on the left side of the helmet 10. It will be apparent that a left-handed batter would require a batting helmet with the protective flap 11 on the batter's right side of the helmet, and such an arrangement would be the mirror image of the helmet 10 in the following description.

Figure 2:
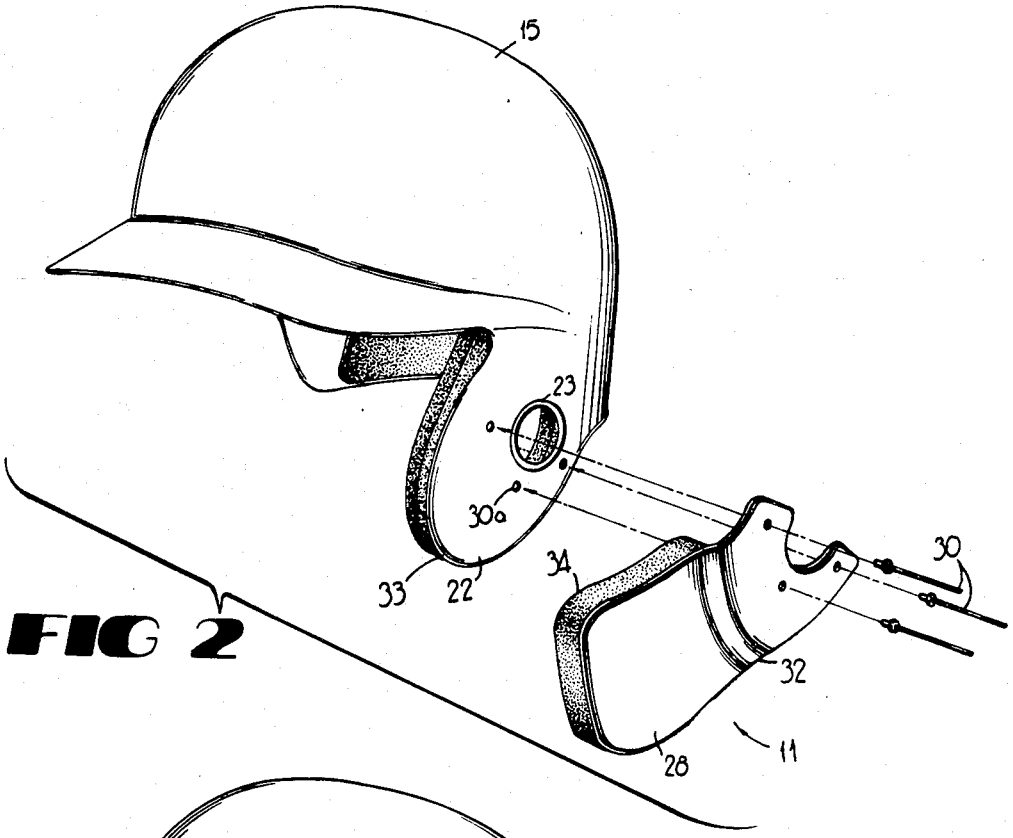
FIG. 2 is an enlarged pictorial view of the helmet shown in FIG. 1, with the protective flap shown exploded from the shell of the helmet.
Figure 3:
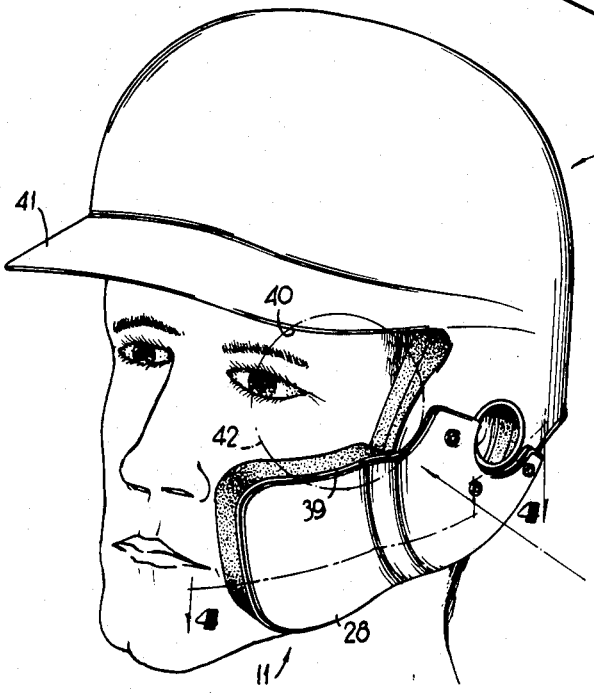
FIG. 3 is a pictorial view as in FIG. 2, showing the helmet assembled and worn by a batter.

Turning to FIGS. 2 and 3, the helmet 10 includes a somewhat done-shaped shell 15 configured to fit over the batter's head in the manner of conventional batting helmets. A helmet sized for a particular wearer typically has a sheel 15 slightly larger than the wearer's head size, and includes padding on the inside 16 of the shell. The padding actually contacts the wearer's head and snugly supports the helmet on the head. This padding, best seen in FIG. 5, includes a resilient band 17 extending around the sides and front of the inside 16 of the helmet shell 15 to contact the wearer's head, and back padding 18 accommodating the back of the wearer's head and assuring a snug fit of the helmet of the head. Additional padding 19, typically circular in shape, is affixed at the top of the shell inside 16 and helps locate the shell on the batter's head.

The padding material within the helmet shell 15 is a suitable material which dissipates impact force; appropriate padding can either be crushable material such as cellular polystyrene (sold under the trademark Styrofoam), or suitable noncrushing elastomers having a relatively low rate of elasticity to prevent the batter's head from rebounding within the helmet due to compression and sudden expansion of the elastomeric material. It is thus seen that the padding 17 . . . 19 isolates the helmet shell 15 from the batter's cranium.

One side of the batter's helmet 10 extends downwardly as at 22, FIG. 2, to cover the batter's ear on the side facing the pitcher. This ear cover 22 includes a cutout 23 over the batter's ear, and the inner side of the ear cover is surrounded by an annular ring of padding 24 best seen in FIG. 5. The ear cover 22 typically is part of existing batting helmets, and provides a convenient anchor point for attaching the protective flap 11 when retrofitting the protective flap to existing batting helmets.

The protective flap 11 extends forwardly from the ear cover 22 on the side of the helmet shell 15, on a path approximately paralleling the longitudinal extent of the jawbone, terminating at a distal or forward end 27 (FIG. 5) spaced in front of the ear cover. The longitudinal extent of the protective flap 11 thus is mainly horizontal, albeit angled downwardly to the extent needed for overlapping the forward extent of the batter's jaw, as best seen in FIG. 5. The protective flap has an outer shell 28 made of a rigid impact-resistant material such as polycarbonate plastic (available under the trademark "LEXAN" from General Electric Co.) or the like. The shell 28 at is proximal for back end 29 (FIG. 4) overlaps and snugly contacts a mating part of the helmet shell making up the ear cover 22. A plurality of fasteners such as the rivets 30, or screw fasteners or the like, extend through mating fastener holes 30*a* in the ear cover 22 and in the back end 29, permanently connecting the protective flap 11 to the helmet 10 in a predetermined and fixed position.

Figure 4:
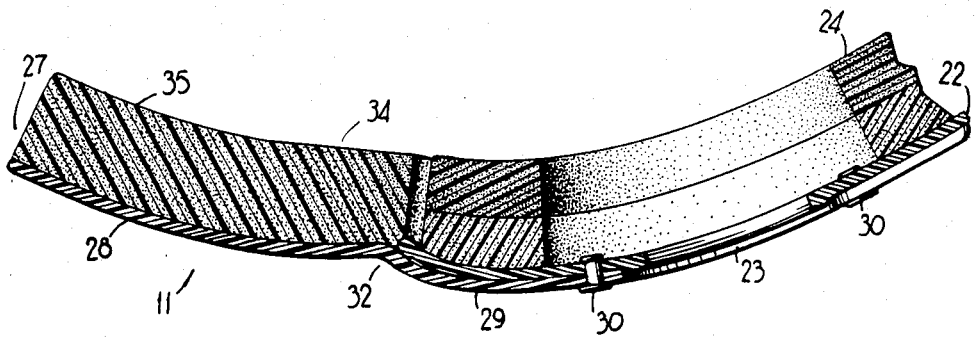
FIG. 4 is a horizontal section view taken along line 4—4 of FIG. 3.
Figure 5:
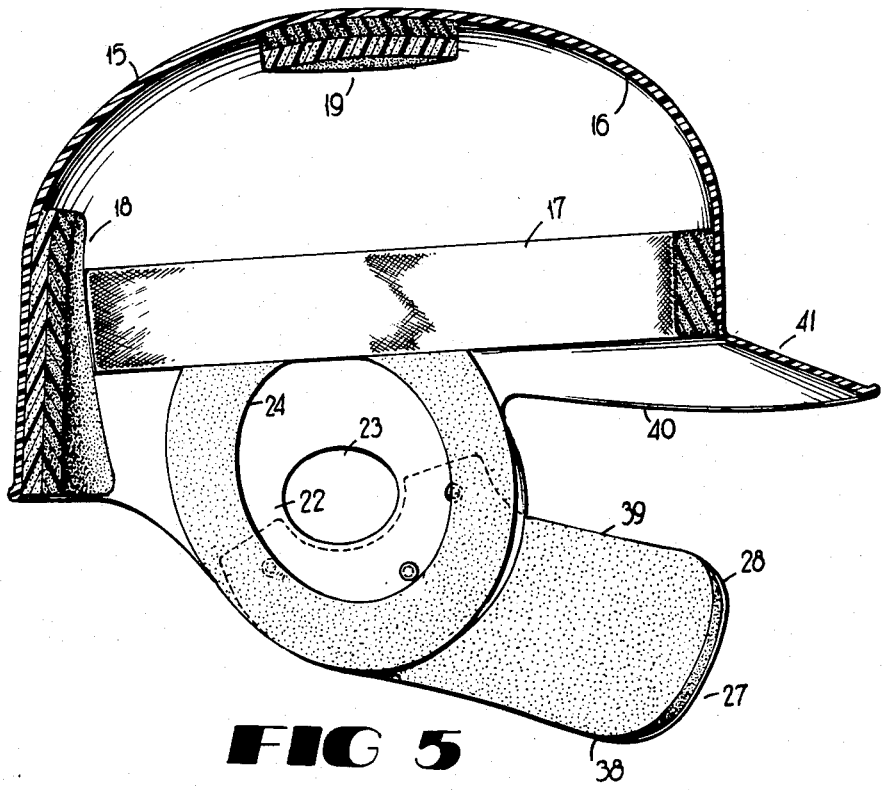
FIG. 5 is a vertical section view of the helmet, showing an inner side view of the disclosed embodiment.

The back end 29 of the shell 28 for the protective flap 11 is arcuately shaped to follow the contour of mating portions of the ear cover 22, as best seen in FIG. 4, assuring a snug and secure attachment between the protective flap and the helmet. The contour of the shell 28 jogs inwardly at 32, immediately in front of the curved outer edge 33 of the ear cover 22, and thereafter extends forwardly to the front end 27 along a slightly curved path approximating the curvature of the confronting portion of the batter's cheek and jaw. Between the job 32 and the forward end 27, the shell 28 is spaced outwardly from the batter's face, and padding material 34 is affixed to the inner surface of the shell extending to the edges of the protective flap.

The inside surface 35 of the padding 34 preferably is maintained a fraction of an inch spaced apart from the adjacent cheek and jaw of the batter's face, so as not to interfere with normal functioning of the batter's jaw and mouth while the helmet is worn. However, when a pitched ball or the like impacts the outer surface of the shell 28, the resiliency and cantilever construction of the protective flap 11 momentarily bends the shell inwardly toward the batter's face, whereupon the padding 34 contacts the batter's face to absorb and dissipate the impact in a relatively noninjurious manner over a large area on the batter's jaw and cheek. The amount if kinetic energy imparted to any localized area of the cheek or jaw thus is significantly less than if the cheek or jaw were unprotected and struck by the ball. The padding 34 on the inside of the protective flap shell 28 preferably is shock foam or the like.

The upper longitudinal edge 39 of the protective flap 11 should be spaced far enough below the confronting adjacent side edge 40 of the helmet visor 41 to leave the batter's field of vision substantially unimpeded, on the helmet side facing the pitcher. However, it is important that the spacing between the upper edge 39 of the protective flap, and the confronting side 40 of the visor, be sufficiently less than the diameter of the baseball or other ball in play to block a pitched ball. This arrangement is illustrated in FIG. 3, where a baseball 42 is outlined in phantom as though the ball were stricking squarely in the open space between the protective flap 11 and the side 40 of the visor 41. The relative dimensions of the ball and the open space prevent the ball from penetrating this open space, and thus protect the batter's eyes and upper portions of this cheekbone from serious injury. Because the protective flap 11 is cantilevered to the helmet and bends under the impact of a pitched ball, the open space is somewhat narrower than the minimum interference fit of a stationary ball. The actual preferred spacing between the protective flap and the visor depends on factors including the length and construction of the protective flap, and is best determined by experiment. In a specific embodiment intended for use by major-league baseball players, the spacing between visor 41 and flap 11 is 1.5 inch, measured where the visor joins the outer edge 33 of the ear cover 22 on the helmet. The arrangement thus described allows the batter substantially unimpeded vision toward the pitcher and oncoming balls as the batter takes his stance, illustrated in FIG. 1.

It will be understood that the protective flap of the present invention can readily be retrofitted to existing batting helmets including the conventional ear cover 22, simply by drilling the appropriate holes 30*a* in the ear cover to accommodate the fastening rivets 30, or screws or the like. These holes 30*a* must be accurately located to insure the proper angular location of the protective flap 11 relative to the helmet visor 40, or else the spacing between visor and protective flap may exceed the diameter of the ball in play. Accordingly, protective flaps intended for retrofitting on existing batting helmets preferably are supplied with a template which temporarily fits over the ear cover 22 and locates the holes 30*a* for drilling in the ear cover. Alternatively, existing batting helmets can be returned to the manufacturer or another location equipped with tooling fixtures which accurately and reliably locate the holes 30*a* in the ear cover 22 of each helmet.

Although the foregoing description pertains to protective flaps 11 as a separate element attached to a helmet shell 15, it should now be apparent that the entire shell 15 incorporating the protective flap 11 can alternatively be manufactured as a unitary article. With this alternative construction, the back end 29 of the present protective flap 11 becomes a unitary extension of the ear cover 22, and the rigid outer shell of the ear cover extends forwardly to comprise the shell 28 of the protective flap. The padding 34 is implaced on the inner surface of that forward extent, either as a separate element of padding extending slightly inwardly from the batter's face as mentioned above, or as a continuation of the padding 24 surrounding the ear cover but displaced outwardly to avoid contacting the cheek and jaw.

It should also be apparent that the foregoing relates only to preferred embodiments of the present invention, and that numerous changes and modifications may be made therein without departing from the spirit or scope of the invention as defined in the following claims.

I claim:

1. In a protective helmet of rigid, impact-resistant material adapted to be worn by batters and the like and having a domed shell configured to fit on the head of a player and a visor extending forwardly from said shell beyond the player's forehead. the improvement comprising a protective flap of rigid, impact-resistant material secured to and supported at one end by said shell adjacent to the ear of a wearer and cantilevered therefrom in spaced substantially parallel relation to the cheek and jaw on one side of the face of the player, said flap having a free end adjacent the chin of the player and having a lower edge approximately paralleling the lower line of the jaw of the player and an upper edge spaced below said visor to provide for unobstructed vision between said visor and said flap while cooperating with said visor to prevent a ball from penetrating between said visor and said flap.

2. In the protective helmet of claim 1 wherein shock-absorbing padding is disposed on the inner surface of said flap.

3. In the protective helmet of claim 1 wherein said shell includes a said panel extending downwardly on one side to cover the ear of a player and said protective flap extends from said panel.

4. In the protective helmet of claim 3 wherein said protective flap is secured to said side panel.

5. In the protective helmet of claim 4 wherein said protective flap includes a fastening portion overlying and conforming to the surface configuration of said side panel, and fastening means for securing said fastening portion to said side panel.

6. A protective flap for attachment to a helmet of rigid impact-resistant material, said protective flap being formed of rigid, impact-resistant material and having a fastening portion with a surface conforming to the surface configuration of the helmet adjacent to the ear portion thereof and means for securing said fastening portion to said helmet, said protective flap having a flap portion extending forwardly from said fastening portion and having a lower edge approximately paralleling the longitudinal extent of a jawbone and an upper edge adapted to cooperate with the visor of a helmet to provide unobstructed vision while preventing a ball from penetrating between said flap and the visor of a helmet and shock-absorbing padding disposed on the inner surface of the flap portion extending forwardly from said fastening portion.

* * * * *